US009738985B2

(12) United States Patent
Nagasaka et al.

(10) Patent No.: US 9,738,985 B2
(45) Date of Patent: Aug. 22, 2017

(54) IMMERSION-TYPE SURFACE TREATMENT TANK

(71) Applicants: TOYOTA JIDOSHA KABUSHIKI KAISHA, Toyota-shi, Aichi-ken (JP); TRINITY INDUSTRIAL CORP., Toyota-shi, Aichi-ken (JP)

(72) Inventors: Kazutaka Nagasaka, Miyoshi (JP); Keiichi Fujiwara, Toyota (JP); Kenichi Furuta, Nagakute (JP); Suguru Nakamura, Higashioumi (JP); Akio Takada, Nagoya (JP); Issei Nozaki, Toyota (JP); Isamu Takahashi, Seto (JP)

(73) Assignees: TOYOTA JIDOSHA KABUSHIKI KAISHA, Toyota (JP); TRINITY INDUSTRIAL CORP., Toyota (JP)

( * ) Notice: Subject to any disclaimer, the term of this patent is extended or adjusted under 35 U.S.C. 154(b) by 0 days.

(21) Appl. No.: 15/131,570

(22) Filed: Apr. 18, 2016

(65) Prior Publication Data

US 2016/0312375 A1 Oct. 27, 2016

(30) Foreign Application Priority Data

Apr. 22, 2015 (JP) ..... 2015-087459

(51) Int. Cl.

| | |
|---|---|
| ***C25D 17/02*** | (2006.01) |
| ***C25D 13/02*** | (2006.01) |
| ***C25D 13/22*** | (2006.01) |

(52) U.S. Cl.
CPC ..... *C25D 13/22* (2013.01)

(58) Field of Classification Search
CPC ..... C25D 13/22
See application file for complete search history.

(56) References Cited

FOREIGN PATENT DOCUMENTS

| | | |
|---|---|---|
| JP | H01-106572 U | 7/1989 |
| JP | 2002-235197 A | 8/2002 |
| JP | 2007-284750 A | 11/2007 |

*Primary Examiner* — Kishor Mayekar
(74) *Attorney, Agent, or Firm* — Oliff PLC

(57) ABSTRACT

An immersion-type surface treatment tank includes a treatment tank body including: a single tank internal space elongated in a plan view, and a nozzle that ejects an electrodeposition paint into the tank internal space. The treatment tank body includes: a first tank inner side surface extending along a longitudinal direction of the tank internal space; a second tank inner side surface facing the first tank inner side surface and extending along the longitudinal direction; and a rectifying plate that is formed halfway in the longitudinal direction and changes a flow direction of the electrodeposition paint such that the electrodeposition paint flowing horizontally along the first tank inner side surface is directed toward the second tank inner side surface. The rectifying plate changes the flow direction of the electrodeposition paint, thereby forming, in the tank internal space, at least two horizontal swirl flows adjacent to each other in the longitudinal direction.

4 Claims, 4 Drawing Sheets

IMMERSION-TYPE SURFACE TREATMENT TANK

INCORPORATION BY REFERENCE

This application is based upon and claims the benefit of priority from Japanese patent application No. 2015-087459, filed on Apr. 22, 2015, the disclosure of which is incorporated herein in its entirety by reference.

BACKGROUND OF THE INVENTION

1. Field of the Invention

The present invention relates to an immersion-type surface treatment tank.

2. Description of Related Art

Japanese Unexamined Patent Application Publication No. 2002-235197 discloses a technique for performing electrodeposition coating in an electrodeposition tank filled with an electrodeposition paint. In electrodeposition coating, it is necessary to agitate the electrodeposition paint constantly because electrodeposition paint particles are liable to settle out. The agitation of the electrodeposition paint is achieved by a swirl flow.

The electrodeposition tank disclosed in Japanese Unexamined Patent Application Publication No. 2002-235197 described above is formed in an elongated shape so that a plurality of objects to be treated can be immersed simultaneously, which is advantageous from the viewpoint of productivity. If a swirl flow is formed in such an elongated electrodeposition tank, the flow is likely to be turbulent and a lot of energy is required to obtain a predetermined flow rate.

It is an object of the present invention to provide a technique for forming a horizontal swirl flow with less energy in a single tank internal space having an elongated shape in a plan view.

SUMMARY OF THE INVENTION

An exemplary aspect of the present invention is an immersion-type surface treatment tank including: a treatment tank body including a single tank internal space having an elongated shape in a plan view; and a nozzle that ejects a treatment liquid into the tank internal space. The treatment tank body includes: a first tank inner side surface extending along a longitudinal direction of the tank internal space; a second tank inner side surface that faces the first tank inner side surface and extends along the longitudinal direction of the tank internal space; and a first rectifying portion that is formed halfway in the longitudinal direction of the first tank inner side surface and changes a direction of a flow of the treatment liquid in such a manner that the treatment liquid flowing horizontally along the first tank inner side surface is directed toward the second tank inner side surface. The first rectifying portion changes the direction of the flow of the treatment liquid, thereby forming, in the tank internal space, at least two horizontal swirl flows adjacent to each other in the longitudinal direction of the tank internal space. According to the structure described above, an energy loss can be reduced in comparison to a case where only one horizontal swirl flow is formed in the tank internal space. Therefore, horizontal swirl flows can be formed with less energy in the tank internal space having an elongated shape in a plan view.

The treatment tank body further includes a second rectifying portion formed on the second tank inner side surface in such a manner that the second rectifying portion faces the first rectifying portion. The second rectifying portion changes the direction of the flow of the treatment liquid in such a manner that when the first rectifying portion changes the direction of the flow of the treatment liquid, the treatment liquid flowing from the first tank inner side surface to the second tank inner side surface flows along the second tank inner side surface. According to the structure described above, an energy loss when the treatment liquid hits the second tank inner side surface can be reduced.

The first rectifying portion has a curved rectifying surface that is curved to change the direction of the flow of the treatment liquid in such a manner that the treatment liquid flowing horizontally along the first tank inner side surface is directed toward the second tank inner side surface.

The nozzle is opened to the curved rectifying surface of the first rectifying portion, and the nozzle is disposed so as to eject the treatment liquid toward the second tank inner side surface.

According to an exemplary aspect of the present invention, it is possible to form a horizontal swirl flow with less energy in a single tank internal space having an elongated shape in a plan view.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

An exemplary embodiment of the present invention will be described below with reference to FIGS. 1 to 4.

Figure 1:
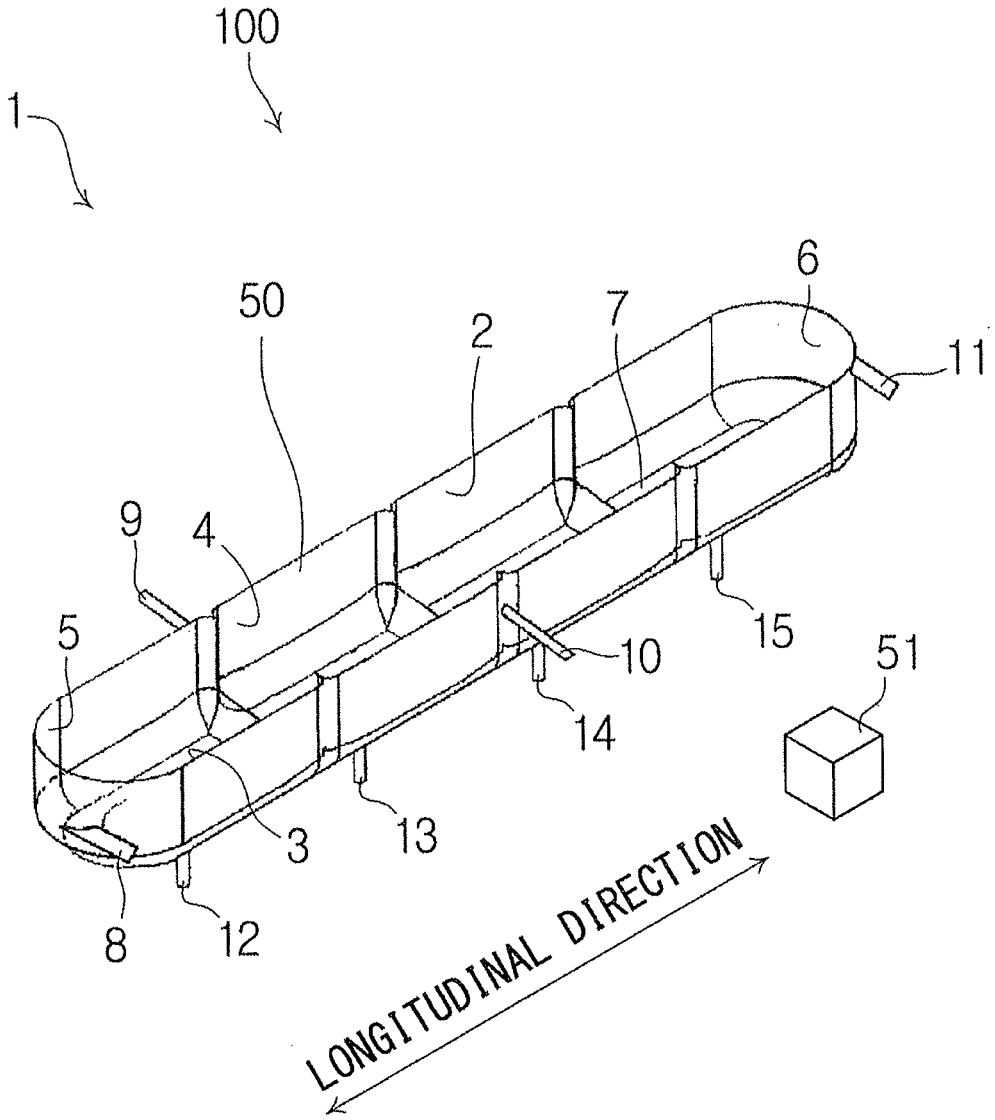
FIG. 1 is a perspective view of an immersion-type surface treatment tank.
Figure 2:
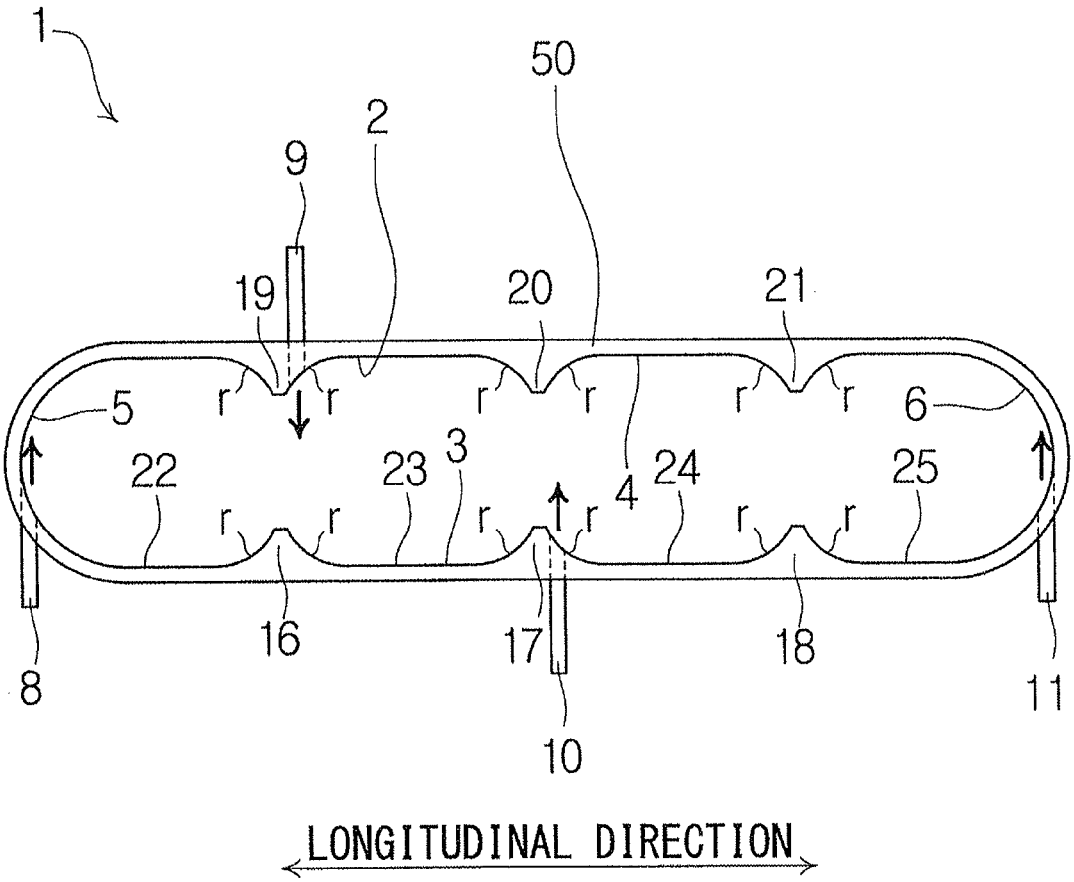
FIG. 2 is a plan view of the immersion-type surface treatment tank.

As shown in FIGS. 1 and 2, an immersion-type surface treatment tank 1 includes a single tank internal space 2 having an elongated shape in a plan view. The tank internal space 2 is filled with an electrodeposition paint (treatment liquid) which is not shown. An object to be treated is immersed in the electrodeposition paint, whereby a surface treatment is performed on the object to be treated. The longitudinal direction of the tank internal space 2 is indicated by an arrow in FIGS. 1 and 2. Hereinafter, the term "longitudinal direction" refers to the longitudinal direction of the tank internal space 2, unless otherwise indicated.

The immersion-type surface treatment tank 1 includes a treatment tank body 50 including the above-mentioned tank internal space 2; a first ejection nozzle 8; a second ejection nozzle 9; a third ejection nozzle 10 (nozzle); a fourth ejection nozzle 11; a first discharge nozzle 12; a second discharge nozzle 13; a third discharge nozzle 14; and a fourth discharge nozzle 15.

The treatment tank body 50 has a first tank inner side surface 3, a second tank inner side surface 4, a first end face 5, a second end face 6, and a bottom surface 7.

Each of the first tank inner side surface 3, the second tank inner side surface 4, the first end face 5, the second end face 6, and the bottom surface 7 is a part of the inner surface of the immersion-type surface treatment tank 1. The tank internal space 2 is defined by the first tank inner side surface 3, the second tank inner side surface 4, the first end face 5, the second end face 6, and the bottom surface 7.

The first tank inner side surface 3 and the second tank inner side surface 4 are side surfaces facing each other. The first tank inner side surface 3 and the second tank inner side surface 4 extend along the longitudinal direction. The first tank inner side surface 3 and the second tank inner side surface 4 are formed in a substantially flat shape.

The first end face 5 and the second end face 6 are end faces facing each other. The first end face 5 and the second end face 6 are each formed in a curved shape.

The first tank inner side surface 3, the second end face 6, the second tank inner side surface 4, and the first end face 5 are continuously formed in this order and form the inner peripheral surface of the tank internal space 2.

As shown in FIG. 2, a rectifying plate 16, a rectifying plate 17 (first rectifying portion), and a rectifying plate 18 are formed halfway in the longitudinal direction of the first tank inner side surface 3. The rectifying plate 16, the rectifying plate 17, and the rectifying plate 18 are disposed at regular intervals. The rectifying plate 16, the rectifying plate 17, and the rectifying plate 18 project toward the second tank inner side surface 4 from the first tank inner side surface 3 in the tank internal space 2. The rectifying plate 16, the rectifying plate 17, and the rectifying plate 18 are elongated in the vertical direction. The rectifying plate 16, the rectifying plate 17, and the rectifying plate 18 are gradually narrowed in a direction in which they project into the tank internal space 2 in a plan view. The rectifying plate 16 includes two curved rectifying surfaces r. The two curved rectifying surfaces r are formed in a curved shape so as to change the direction of the flow of the electrodeposition paint in such a manner that the electrodeposition paint flowing horizontally along the first tank inner side surface 3 is directed toward the second tank inner side surface 4 and the electrodeposition paint flowing from the second tank inner side surface 4 to the first tank inner side surface 3 flows along the first tank inner side surface 3. Like the rectifying plate 16, each of the rectifying plate 17 and the rectifying plate 18 also includes two curved rectifying surfaces r.

A rectifying plate 19, a rectifying plate 20 (second rectifying portion), and a rectifying plate 21 are formed halfway in the longitudinal direction of the second tank inner side surface 4. The rectifying plate 19, the rectifying plate 20, and the rectifying plate 21 are disposed at regular intervals. The rectifying plate 19, the rectifying plate 20, and the rectifying plate 21 project toward the first tank inner side surface 3 from the second tank inner side surface 4 in the tank internal space 2. The rectifying plate 19, the rectifying plate 20, and the rectifying plate 21 are gradually narrowed in a direction in which they project into the tank internal space 2 in a plan view. Like the rectifying plate 16, each of the rectifying plate 19, the rectifying plate 20, and the rectifying plate 21 also includes two curved rectifying surfaces r.

The rectifying plate 16 and the rectifying plate 19 face each other in the direction perpendicular to the longitudinal direction. Similarly, the rectifying plate 17 and the rectifying plate 20 face each other in the direction perpendicular to the longitudinal direction, and the rectifying plate 18 and the rectifying plate 21 face each other in the direction perpendicular to the longitudinal direction.

It can be said that, in the structure described above, the tank internal space 2 includes a first tank internal space portion 22, a second tank internal space portion 23, a third tank internal space portion 24, and a fourth tank internal space portion 25. The first tank internal space portion 22, the second tank internal space portion 23, the third tank internal space portion 24, and the fourth tank internal space portion 25 are obtained by dividing the tank internal space 2 into four parts in the longitudinal direction. The first tank internal space portion 22 and the second tank internal space portion 23 are partitioned by the rectifying plate 16 and the rectifying plate 19. The second tank internal space portion 23 and the third tank internal space portion 24 are partitioned by the rectifying plate 17 and the rectifying plate 20. The third tank internal space portion 24 and the fourth tank internal space portion 25 are partitioned by the rectifying plate 18 and the rectifying plate 21.

Figure 3:
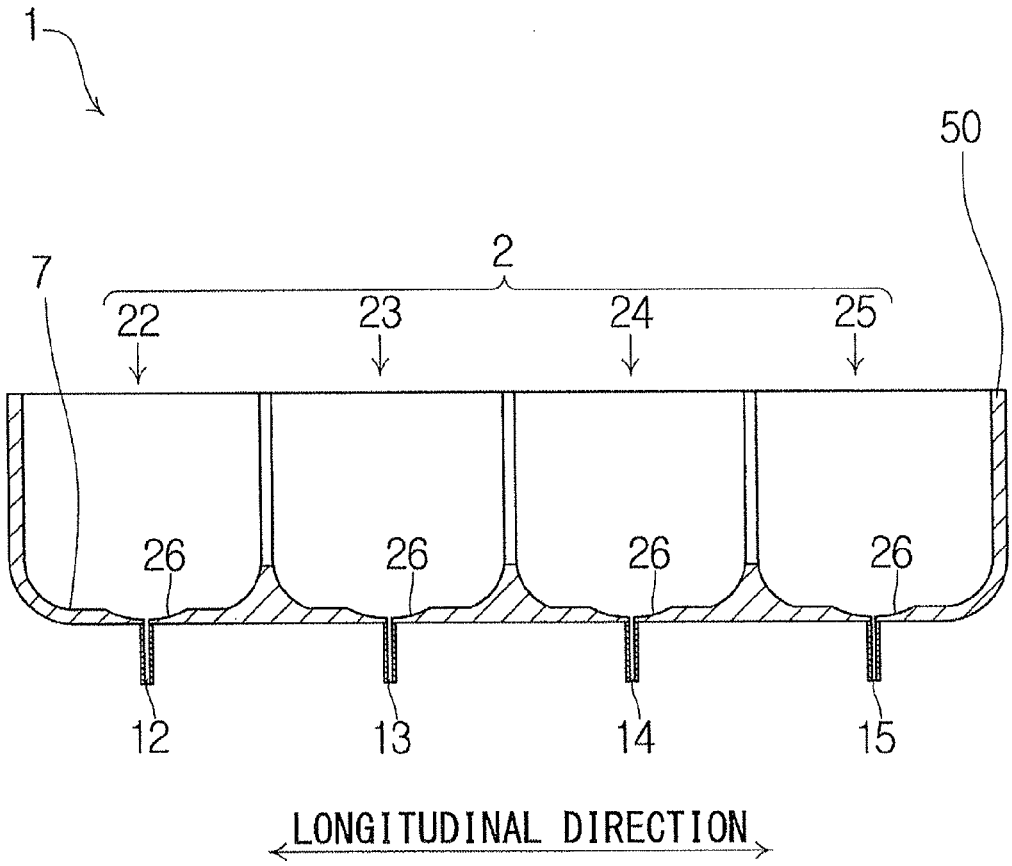
FIG. 3 is a sectional view of the immersion-type surface treatment tank.

As shown in FIG. 3, the bottom surface 7 has four dents 26 formed therein. The dents 26 are formed in the first tank internal space portion 22, the second tank internal space portion 23, the third tank internal space portion 24, and the fourth tank internal space portion 25, respectively.

As shown in FIG. 2, the first ejection nozzle 8 is opened to the first end face 5. The first ejection nozzle 8 is disposed so as to eject the electrodeposition paint horizontally along the first end face 5. The first ejection nozzle 8 is disposed so that a horizontal swirl flow is formed clockwise in a plan view in the first tank internal space portion 22.

The second ejection nozzle 9 is opened to the curved rectifying surface r on the second tank internal space portion 23 side of the rectifying plate 19. The second ejection nozzle 9 is disposed so as to eject the electrodeposition paint horizontally along the curved rectifying surface r on the second tank internal space portion 23 side of the rectifying plate 19. The second ejection nozzle 9 is disposed so that a horizontal swirl flow is formed counterclockwise in a plan view in the second tank internal space portion 23. Specifically, the second ejection nozzle 9 is disposed so as to eject the electrodeposition paint toward the curved rectifying surface r on the second tank internal space portion 23 side of the rectifying plate 16.

The third ejection nozzle 10 is opened to the curved rectifying surface r on the third tank internal space portion 24 side of the rectifying plate 17. The third ejection nozzle 10 is disposed so as to eject the electrodeposition paint horizontally along the curved rectifying surface r on the third tank internal space portion 24 side of the rectifying plate 17. The third ejection nozzle 10 is disposed so that a horizontal swirl flow is formed clockwise in a plan view in the third tank internal space portion 24. Specifically, the third ejection nozzle 10 is disposed so as to eject the electrodeposition paint toward the curved rectifying surface r on the third tank internal space portion 24 side of the rectifying plate 20. The third ejection nozzle 10 is disposed so as to eject the electrodeposition paint toward the second tank inner side surface 4.

The fourth ejection nozzle 11 is opened to the second end face 6. The fourth ejection nozzle 11 is disposed so as to eject the electrodeposition paint horizontally along the second end face 6. The fourth ejection nozzle 11 is disposed so that a horizontal swirl flow is formed counterclockwise in a plan view in the fourth tank internal space portion 25.

Figure 4:
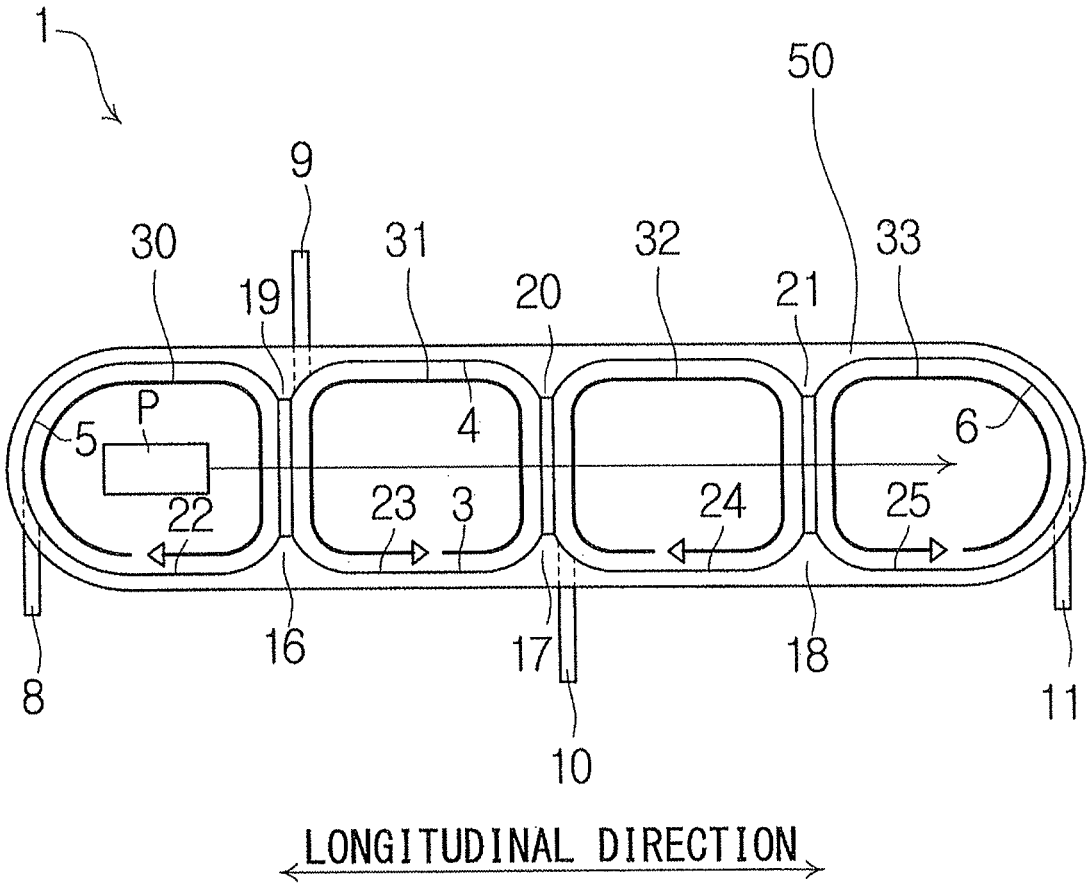
FIG. 4 is a plan view of the immersion-type surface treatment tank.

In the structure described above, when the electrodeposition paint is ejected from the first ejection nozzle 8, the second ejection nozzle 9, the third ejection nozzle 10, and the fourth ejection nozzle 11, as shown in FIG. 4, a first horizontal swirl flow 30 is formed clockwise in a plan view in the first tank internal space portion 22; a second horizontal swirl flow 31 is formed counterclockwise in a plan view in the second tank internal space portion 23; a third horizontal swirl flow 32 is formed clockwise in a plan view in the third tank internal space portion 24; and a fourth horizontal swirl flow 33 is formed counterclockwise in a plan view in the fourth tank internal space portion 25. This structure will be described in detail below.

The electrodeposition paint ejected from the first ejection nozzle 8 flows horizontally along the first end face 5 in the first tank internal space portion 22, and then flows horizontally along the second tank inner side surface 4. After that, the electrodeposition paint reaches the curved rectifying surface r on the first tank internal space portion 22 side of the rectifying plate 19. When the electrodeposition paint reaches the curved rectifying surface r on the first tank internal space portion 22 side of the rectifying plate 19, the flow direction of the electrodeposition paint is changed by 90 degrees clockwise in a plan view, so that the electrodeposition paint is directed toward the first tank inner side surface 3. Then, the electrodeposition paint reaches the curved rectifying surface r on the first tank internal space portion 22 side of the rectifying plate 16. When the electrodeposition paint reaches the curved rectifying surface r on the first tank internal space portion 22 side of the rectifying plate 16, the flow direction of the electrodeposition paint is changed by 90 degrees clockwise in a plan view, so that the electrodeposition paint flows horizontally along the first tank inner side surface 3. Then, the electrodeposition paint returns to the first end face 5. As described above, the electrodeposition paint flows horizontally along the first end face 5, the second tank inner side surface 4, the rectifying plate 19, the rectifying plate 16, and the first tank inner side surface 3 in this order in the first tank internal space portion 22, with the result that the first horizontal swirl flow 30 is formed.

Similarly, the electrodeposition paint ejected from the second ejection nozzle 9 flows horizontally along the curved rectifying surface r on the second tank internal space portion 23 side of the rectifying plate 16, the first tank inner side surface 3, the curved rectifying surface r on the second tank internal space portion 23 side of the rectifying plate 17, the curved rectifying surface r on the second tank internal space portion 23 side of the rectifying plate 20, the second tank inner side surface 4, and the curved rectifying surface r on the second tank internal space portion 23 side of the rectifying plate 19 in this order in the second tank internal space portion 23, with the result that the second horizontal swirl flow 31 is formed.

Similarly, the electrodeposition paint ejected from the third ejection nozzle 10 flows horizontally along the curved rectifying surface r on the third tank internal space portion 24 side of the rectifying plate 20, the second tank inner side surface 4, the curved rectifying surface r on the third tank internal space portion 24 side of the rectifying plate 21, the curved rectifying surface r on the third tank internal space portion 24 side of the rectifying plate 18, the first tank inner side surface 3, and the curved rectifying surface r on the third tank internal space portion 24 side of the rectifying plate 17 in this order in the third tank internal space portion 24, with the result that the third horizontal swirl flow 32 is formed.

Similarly, the electrodeposition paint ejected from the fourth ejection nozzle 11 flows horizontally along the second end face 6, the second tank inner side surface 4, the curved rectifying surface r on the fourth tank internal space portion 25 side of the rectifying plate 21, the curved rectifying surface r on the fourth tank internal space portion 25 side of the rectifying plate 18, the first tank inner side surface 3, and the second end face 6 in this order in the fourth tank internal space portion 25, with the result that the fourth horizontal swirl flow 33 is formed.

As shown in FIG. 3, the first discharge nozzle 12 is opened to the dent 26 in the first tank internal space portion 22. Similarly, the second discharge nozzle 13 is opened to the dent 26 in the second tank internal space portion 23; the third discharge nozzle 14 is opened to the dent 26 in the third tank internal space portion 24; and the fourth discharge nozzle 15 is opened to the dent 26 in the fourth tank internal space portion 25.

As shown in FIG. 4, an object to be treated P is first immersed in the electrodeposition paint within the first tank internal space portion 22, and then undergoes a surface treatment for a predetermined period of time. Next, the object to be treated P is transported from the first tank internal space portion 22 to the second tank internal space portion 23 and undergoes a surface treatment for a predetermined period of time in the second tank internal space portion 23. Subsequently, the object to be treated P is transported from the second tank internal space portion 23 to the third tank internal space portion 24 and undergoes a surface treatment for a predetermined period of time in the third tank internal space portion 24. After that, the object to be treated P is transported from the third tank internal space portion 24 to the fourth tank internal space portion 25 and undergoes a surface treatment for a predetermined period of time in the fourth tank internal space portion 25. In this manner, the object to be treated P undergoes surface treatments, while being repeatedly moved and stopped in the tank internal space 2. Alternatively, the object to be treated P may undergo surface treatments, while the object to be treated P is moved at a predetermined rate in the longitudinal direction in the tank internal space 2.

The object to be treated P is, for example, a vehicle body frame of a vehicle or a motorbike. The dimensions in the longitudinal direction of the first tank internal space portion 22, the second tank internal space portion 23, the third tank internal space portion 24, and the fourth tank internal space portion 25 are preferably determined so as to accommodate, for example, one vehicle body frame with a margin. Specifically, for example, the dimension in the longitudinal direction of the first tank internal space portion 22 is preferably larger than the dimension in the longitudinal direction of the vehicle body frame. The dent 26 is formed at the axis of rotation of the first horizontal swirl flow 30, and the first discharge nozzle 12 is opened to the dent 26. Accordingly, impurities, such as iron powder, which are collected at the axis of rotation of the first horizontal swirl flow 30, are effectively discharged from the first discharge nozzle 12. The same is true of the second horizontal swirl flow 31, the third horizontal swirl flow 32, and the fourth horizontal swirl flow 33.

As shown in FIG. 1, an immersion-type surface treatment apparatus 100 includes the immersion-type surface treatment tank 1 and a pump 51 (flow imparting means). The pump 51 is a power source that applies kinetic energy to the electrodeposition paint. The pump 51 supplies the electrodeposition paint into the tank internal space 2 through the first ejection nozzle 8, the second ejection nozzle 9, the third ejection nozzle 10, and the fourth ejection nozzle 11, thereby applying kinetic energy to the electrodeposition paint within the tank internal space 2.

The embodiment of the present invention described above has the following features.

The immersion-type surface treatment tank 1 includes: the treatment tank body 50 including a single tank internal space 2 having an elongated shape in a plan view; and the ejection nozzle 10 (nozzle) that ejects an electrodeposition paint (treatment liquid) to the tank internal space 2. The treatment tank body 50 includes: the first tank inner side surface 3 extending along the longitudinal direction of the tank internal space 2; the second tank inner side surface 4 that faces the first tank inner side surface 3 and extends along the longitudinal direction of the tank internal space 2; and the rectifying plate 17 (first rectifying portion) that is formed halfway in the longitudinal direction of the first tank inner side surface 3 and changes the direction of the flow of the electrodeposition paint in such a manner that the electrodeposition paint flowing horizontally along the first tank inner side surface 3 is directed toward the second tank inner side surface 4. The rectifying plate 17 changes the direction of the flow of the electrodeposition paint, thereby forming at least two horizontal swirl flows (the second horizontal swirl flow 31 and the third horizontal swirl flow 32) adjacent to each other in the longitudinal direction of the tank internal space 2 in the tank internal space 2. According to the structure described above, an energy loss can be reduced in comparison to a case where only one horizontal swirl flow is formed in the tank internal space 2. Therefore, horizontal swirl flows can be formed with less energy in the tank internal space 2 having an elongated shape in a plan view.

The treatment tank body 50 further includes the rectifying plate 20 (second rectifying portion) formed on the second tank inner side surface 4 in such a manner that the rectifying plate 20 faces the rectifying plate 17. The rectifying plate 20 changes the direction of the flow of the electrodeposition paint in such a manner that when the direction of the flow of the electrodeposition paint is changed by the rectifying plate 17, the electrodeposition paint flowing from the first tank inner side surface 3 to the second tank inner side surface 4 flows along the second tank inner side surface 4. According to the structure described above, an energy loss when the electrodeposition paint hits the second tank inner side surface 4 can be reduced.

The rectifying plate 17 has the curved rectifying surface r that is curved to change the direction of the flow of the electrodeposition paint in such a manner that the electrodeposition paint flowing horizontally along the first tank inner side surface 3 is directed toward the second tank inner side surface 4. According to the structure described above, an energy loss when the direction of the flow of the electrodeposition paint is changed can be reduced.

The third ejection nozzle 10 (nozzle) is opened to the curved rectifying surface r of the rectifying plate 17. The third ejection nozzle 10 is disposed so as to eject the electrodeposition paint toward the second tank inner side surface 4.

The preferred exemplary embodiment of the present invention described above can be modified as follows, for example.

For example, in the above exemplary embodiment, the rectifying plate 17 is provided as means for changing the direction of the flow of the electrodeposition paint in such a manner that the electrodeposition paint flowing horizontally along the first tank inner side surface 3 is directed toward the second tank inner side surface 4. Alternatively, the nozzle projecting from the first tank inner side surface 3 may be directed toward the second tank inner side surface 4, and by ejecting the electrodeposition paint from the nozzle, the direction of the flow of the electrodeposition paint may be changed in such a manner that the electrodeposition paint flowing horizontally along the first tank inner side surface 3 is directed toward the second tank inner side surface 4. In this case, however, since the nozzle projects from the first tank inner side surface 3, the flow of the electrodeposition paint may become turbulent.

Instead of using the rectifying plate 17 of the above exemplary embodiment, a propeller may be provided on the first tank inner side surface 3 and the propeller may be rotated to change the direction of the flow of the electrodeposition paint in such a manner that the electrode deposition paint flowing horizontally along the first tank inner side surface 3 is directed toward the second tank inner side surface 4.

Furthermore, the nozzle need not necessarily be opened to the curved rectifying surface r of the rectifying plate 17.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An immersion surface treatment tank comprising:

a treatment tank body including a single tank internal space having an elongated shape in a plan view; and a first nozzle and a second nozzle that are configured to eject a treatment liquid into the tank internal space, wherein the treatment tank body includes:

a first tank inner side surface extending along a longitudinal direction of the tank internal space;

a second tank inner side surface that faces the first tank inner side surface and extends along the longitudinal direction of the tank internal space; and a plurality of rectifying portions that are formed at different positions in the longitudinal direction of the first tank inner side surface and the second tank inner side surface and are configured to change a direction of a flow of the treatment liquid ejected by the first nozzle and the second nozzle in such a manner that the treatment liquid flowing horizontally along the first tank inner side surface is directed toward the second tank inner side surface and the treatment liquid flowing horizontally along the second tank inner side surface is directed toward the first tank inner side surface, and the plurality of rectifying portions are configured to change the direction of the flow of the treatment liquid, thereby forming, in the tank internal space, at least two horizontal swirl flows adjacent to each other in the longitudinal direction of the tank internal space.

2. The immersion surface treatment tank according to claim 1, wherein the rectifying portions that are formed on the second tank inner side surface face the rectifying portions that are formed on the first tank inner side surface, and the rectifying portions formed on the second tank inner side surface change the direction of the flow of the treatment liquid in such a manner that the treatment liquid flowing from the first tank inner side surface to the second tank inner side surface is changed to flow along the second tank inner side surface.

3. The immersion surface treatment tank according to claim 1, wherein the rectifying portions formed on the first tank inner side surface have a curved rectifying surface that is curved to change the direction of the flow of the treatment liquid in such a manner that the treatment liquid flowing horizontally along the first tank inner side surface is directed toward the second tank inner side surface.

4. The immersion surface treatment tank according to claim 3, wherein the first nozzle is opened to the curved rectifying surface of the rectifying portion formed on the first tank inner side surface, and the first nozzle is disposed so as to eject the treatment liquid toward the second tank inner side surface.

* * * * *